US005329290A

United States Patent [19]

Schwarz et al.

[11] Patent Number: 5,329,290

[45] Date of Patent: Jul. 12, 1994

[54] MONITOR CONTROL CIRCUIT

[75] Inventors: Stefan Schwarz, Berg; Ian Cartwright, Stockdorf, both of Fed. Rep. of Germany

[73] Assignee: SPEA Software AG, Starnberg, Fed. Rep. of Germany

[21] Appl. No.: 773,920

[22] PCT Filed: Mar. 21, 1990

[86] PCT No.: PCT/EP90/00466

§ 371 Date: Jul. 31, 1992

§ 102(e) Date: Jul. 31, 1992

[87] PCT Pub. No.: WO90/13886

PCT Pub. Date: Nov. 15, 1990

[30] Foreign Application Priority Data

May 12, 1989 [DE] Fed. Rep. of Germany ..... 3915562

[51] Int. Cl.[5] ..... G09G 5/12

[52] U.S. Cl. ..... 345/132; 345/3

[58] Field of Search ..... 340/812, 813, 814, 733, 340/800, 801; 358/11, 140, 145, 133, 134, 136; 345/1, 3, 132, 154, 155

[56] References Cited

U.S. PATENT DOCUMENTS

| | | | |
|---|---|---|---|
| 4,148,070 | 4/1979 | Taylor | 358/140 |
| 4,511,965 | 4/1985 | Rajaram | 340/750 |
| 4,851,834 | 7/1989 | Stockerbrand et al. | 340/801 |
| 4,878,117 | 10/1989 | Ikehira et al. | 358/183 |
| 4,935,893 | 6/1990 | Currie | 340/723 |

FOREIGN PATENT DOCUMENTS

| | | | |
|---|---|---|---|
| 0261791 | 8/1987 | European Pat. Off. | G06G 1/16 |
| 0247710 | 12/1987 | European Pat. Off. . | |
| 3425636 | 1/1988 | Fed. Rep. of Germany . | |
| 3804460 | 9/1988 | Fed. Rep. of Germany . | |
| 2608291 | 6/1988 | France . | |

OTHER PUBLICATIONS

IBM Technical Disclosure Bulletin, vol. 28, No. 6, Nov. 1985 "Video Compatibility Feature".

IBM Technical Disclosure Bulletin, vol. 33 No. 6A Nov. 1990 "Concurrent CRT/PDP Display with Fifo and Frame Buffer".

*Primary Examiner*—Jeffery Brier

*Attorney, Agent, or Firm*—Ralph H. Dougherty

[57] ABSTRACT

A monitor control circuit for driving a monitor, operating at a second pixel frequency, on the basis of a digital image signal having a first pixel frequency. The circuit has a first storage device, constructed as a first in-first out storage device, into which the image signal, having a frequency dependant on the first pixel frequency, can be read by means of a first control device. The circuit further has a video storage device in effective connection with the output of the first storage device. To ensure constant updating of the image signal to be displayed, a second storage device, connected to the video storage device and the first storage device, is adapted for reading data words from the first storage device and writing them into the video storage device in such a manner that the reading of the data words from the first storage device is interrupted when data words are being read from the video storage device. As a result, the number of data words stored in the first storage device which can be re-stored in the video storage device can vary.

20 Claims, 5 Drawing Sheets

*Fig.3*
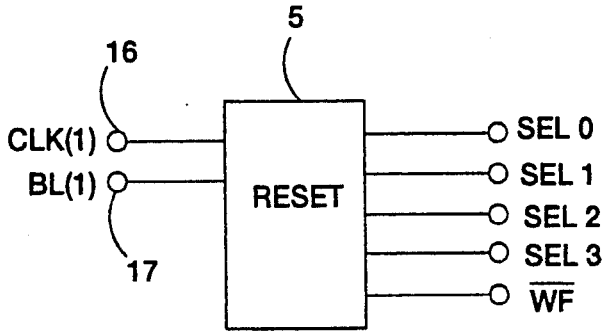
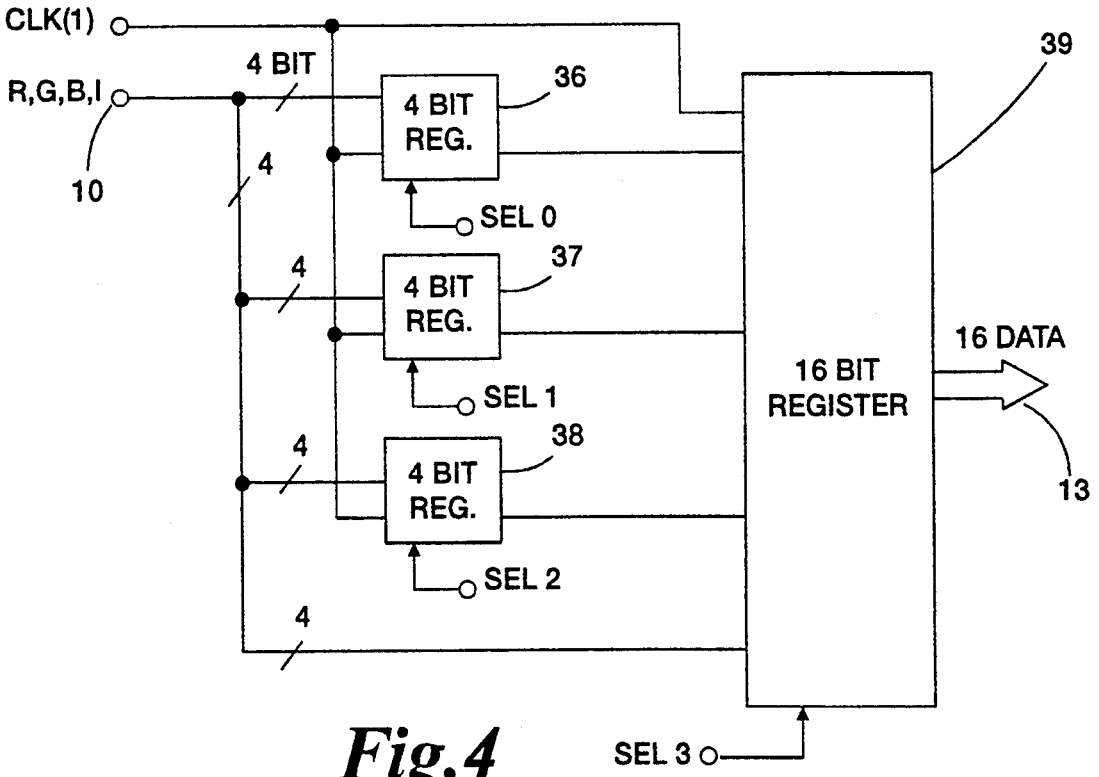
*Fig.4*

Fig.5
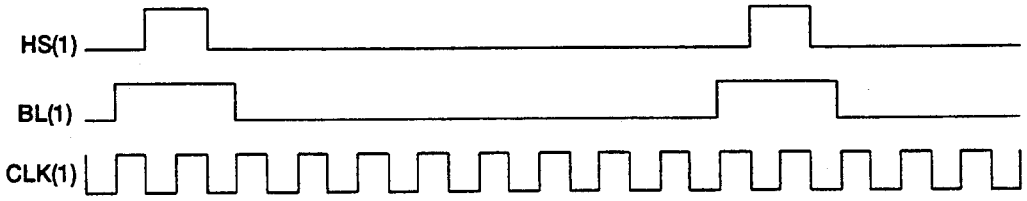
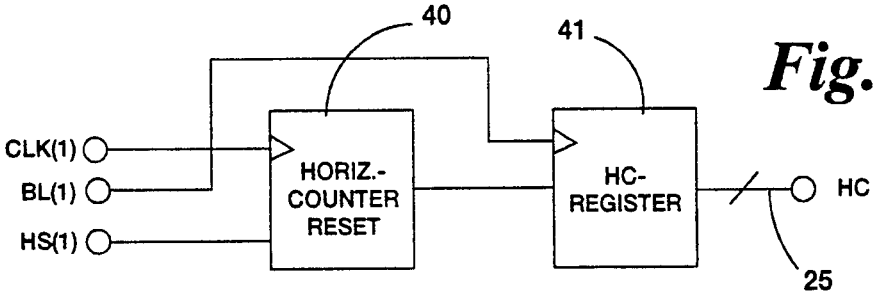
Fig.6
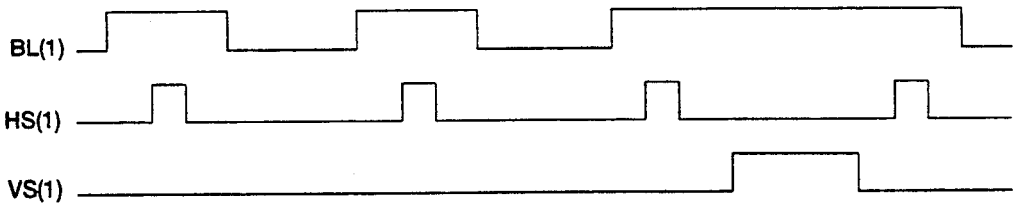
Fig.7
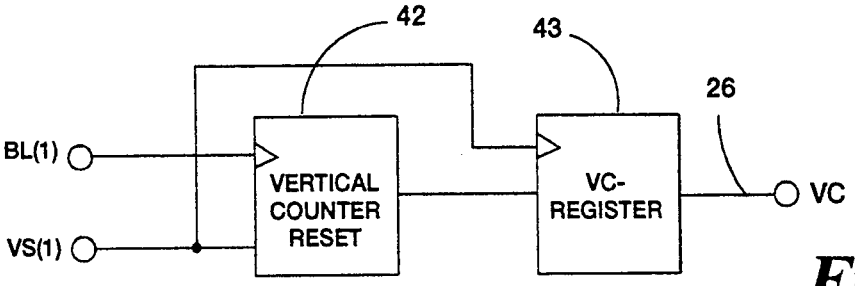
Fig.8

MONITOR CONTROL CIRCUIT

The present invention relates to a monitor control circuit for driving a monitor which operates at a second pixel frequency on the basis of a digital image signal with a first pixel frequency.

As is generally known, computer monitors are driven by graphic cards of different categories depending on the requirements which have to be fulfilled with regard to the screen resolution demanded, said graphic cards differing from one another with respect to the horizontal and the vertical resolution, i.e., the number of pixels in the horizontal and in the vertical direction, as well as with respect to the pixel frequencies. Known graphic card standards are, for example, MDA (320×200 pixels, black-and-white, at 16 MHz pixel frequency), CGA (320×200 pixels, color, at 20 MHz pixel frequency), HERCULES (740×400 pixels, black-and-white, at 27 MHz pixel frequency), EGA (640×350 pixels, color, at 30 MHz pixel frequency), VGA (640×480 pixels, color, at 32 MHz pixel frequency), SUPER-EGA (800×600 and 1,024×768 pixels, respectively, color, at 50 MHz pixel frequency), and, recently, the so called HR (High Resolution) graphic systems with 1,024×768, 1,080 ×1,024 as well as 1,600×1,280 pixels, color, at pixel frequencies between 60 MHz and 170 MHz. To the person skilled in the art it will be obvious that these various graphic standards differ also with regard to the line frequencies, i.e., the inverse of the horizontal synchronization signal periods, which occur at 17 kHz, 22 kHz, 25 kHz, 31.5 kHz, 50 kHz as well as 64 to 84 kHz in the case of the above-mentioned systems.

The wish to be capable of converting the output signals of the various graphic standards into screen images by means of a single monitor has existed for an extended period of time. For this purpose, so called "Multisync" monitors are used at present, such monitors being capable of operating at different horizontal synchronization signal frequencies by means of oscillating circuits which are adapted to be switched over. In view of the fact that the switching over of the "Multisync" monitor from one graphic standard to the next and, consequently, from one operating frequency to the next entails a certain transient recovery time, the switching over of the representation on the screen from one graphic standard to the next will cause interruptions of the screen display or initial image interference. It is self-evident that the complexity of a "Multisync" monitor will increase in proportion to the increase in the number of graphic card standards which can be dealt with by said monitor. The known "Multisync" monitors are also unable to display two segments, which are created by two different graphic cards, on one common screen.

DE-A1-38 04 460 discloses a monitor control circuit for driving a monitor which operates at a second pixel frequency on the basis of a digital image signal with a first pixel frequency, comprising an input-side serial-parallel converter in the form of a shift register whose output has connected thereto a video storage device wherein the input-side image signal can be stored after its serial-parallel conversion. In view of the fact that the storage device is only a shift register for serial-parallel conversion, which, for the purpose of carrying out serial-parallel conversion, is clocked with the clock of the subsystem after the respective appearance of the blank signal of the subsystem, the input-side signal is written into the video storage device at the frequency of its subsystem clock. Due to the lack of synchronism between the writing of the image signal into the video storage device with the first subsystem clock and the reading from the video storage device with the main system clock, there may be overlaps in writing and reading. According to the prior art, these overlaps are eliminated by not updating some image elements of each segment by giving the transfer cycle and, consequently, the reading of the video storage device priority over refreshing. The result of this type of control is that part of the screen content of the respective segments is not up to date.

DE-A1-34 25 636 disclosed that, in the case of a raster recording means, which is provided with an image memory and the raster elements of which have to be controlled in a predetermined sequence, a fifo storage device (first-in-first-out storage device) is arranged between a processor and the recording means. As soon as the fifo storage device is empty, an interrupt command interrupts the program running in the processor, whereupon new data will be written into the fifo storage device, and, when the fifo storage device has been filled, the processor will resume the interrupted program run.

With respect to this prior art, it is the principal object of the present invention to provide a monitor control circuit adapted to be used for driving a monitor, which operates at a second pixel frequency, by means of a digital image signal with a first pixel frequency, the image signals to be displayed being updated in each individual case.

In accordance with the present invention, this object is achieved by a monitor control circuit for driving a monitor, which operates at a second pixel frequency, on the basis of a digital image signal with a first pixel frequency.

The present invention is based on applicants' finding that driving of the monitor operating at the second pixel frequency, which is neither synchronized with the first pixel frequency nor does it normally stand in a fixed, whole number relationship thereto, by means of the image signal having the first pixel frequency is possible, provided that the data words of the digital image signal are temporarily stored in a fifo storage device prior to being stored in a video storage device, which is adapted to be read in a manner known per se in synchronization with the operation of the monitor at the second pixel frequency so as to produce the monitor display. As will be explained in detail hereinbelow, the transmission of the data words from the fifo storage device to the video storage device is effected by means of a control device, which is connected to the video storage device and the fifo storage device and which controls these devices in such a way that data words taken from the fifo storage device can be written into the video storage device.

In the following, one preferred embodiment of the monitor control circuit according to the present invention is explained in detail with reference to the appended drawings, in which:

FIG. 3 is a block diagram of the control device shown in FIG. 1;

FIG. 4 is a block diagram of a register device shown in FIG. 1;

FIG. 5 shows a temporal representation of signal behavior for explaining the mode of operation of a display counting device shown in FIG. 1;

FIG. 6 is a block diagram of a detail of the display counting device according to FIG. 1;

FIG. 7 shows a temporal representation of signal behavior for explaining the function of an additional part of the display counting device shown in FIG. 1;

FIG. 8 is a block diagram of an additional part of the display counting device shown in FIG. 1;

Figure 1:
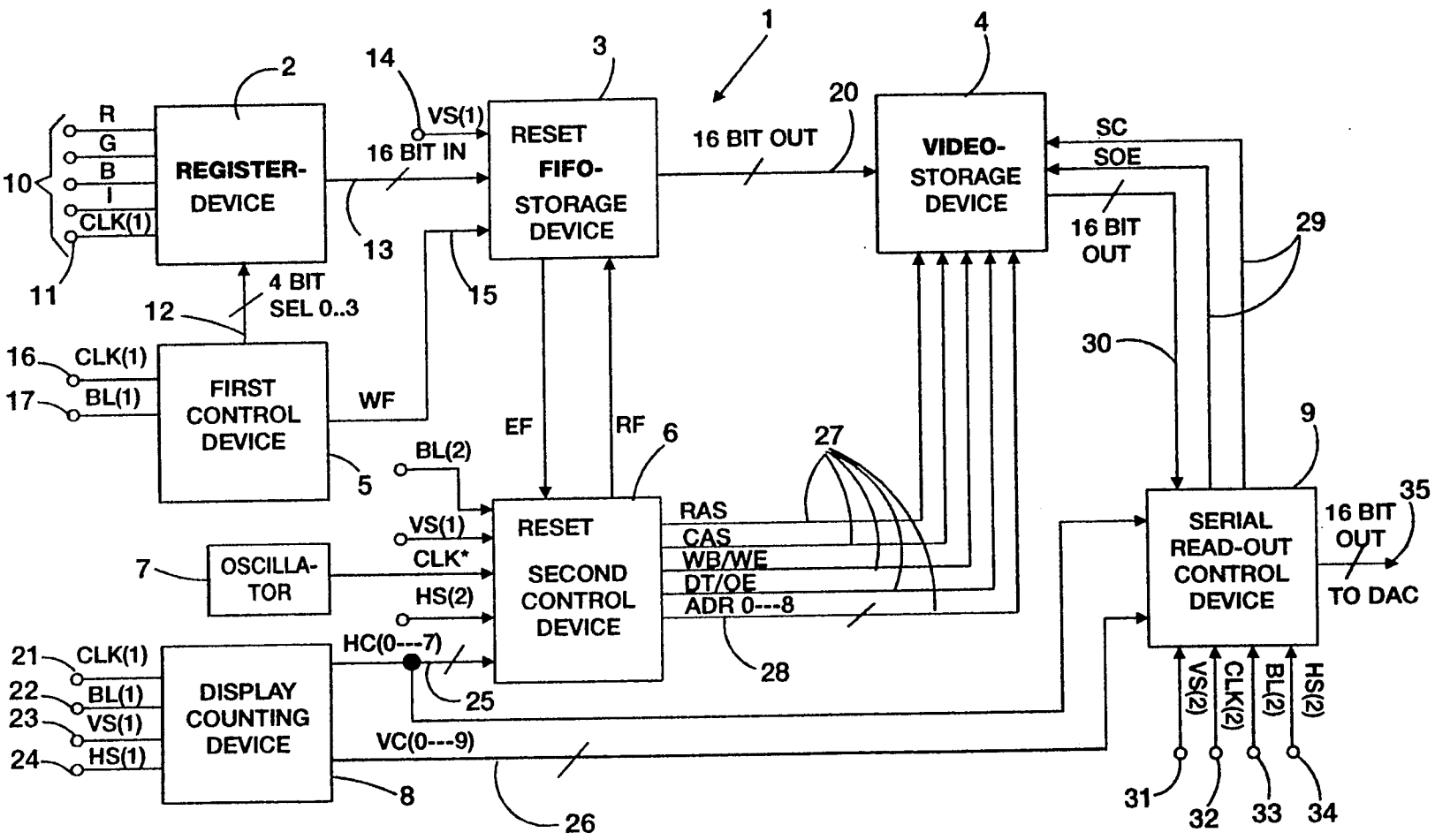
FIG. 1 is a block diagram of an embodiment of the monitor control circuit according to the present invention.

The embodiment of a monitor control device according to the present invention, which is shown in FIG. 1 and which is provided with reference numeral 1 in its entirety, comprises a register device 2, a first storage device 3 designed as a fifo storage device, a video storage device 4, a first control device 5, a second control device 6, an oscillator 7, a display counting device 8 and a serial read-out control device 9.

The register device 2 has its input side connected to an input data bus 10 on which data words of a digital image signal with the first pixel frequency are present. The input data bus 10 can, for example, extend to a VGA interface. In the case of the example shown, the input data bus 10 comprises one connection for each of the three primary colors R, G, B and one connection for a brightness bit I. Each data word represents a pixel having a depth of 4 bits. Furthermore, the register device 2 has on its input side a clock signal input 11 for a clock signal with the first pixel frequency. The register device 2 receives from the first control device 5 selection signals SEL0, SEL1, SEL2, SEL3 via a selection data bus 12 having four bits. The output side of the register device 2 is connected to inputs of the fifo storage device 3 via a first data bus 13, the fifo storage device 3 being additionally provided with a reset input 14 adapted to have supplied thereto a vertical synchronization signal VS(1) of the first image signal. In addition, the first control device 5 supplies a write command signal WF to the fifo storage device 3 at its write input 15. The first control device 5 has a clock input 16 for the first clock signal CLK(1) and a blank input 17 for the blank signal BL(1) of the first image signal.

The output side of the fifo storage device 3 is connected to the video storage device 4 via a second data bus 20.

The display counting device 8 has a clock input 21 for the first clock signal CLK(1), a blank input 22 for the blank signal BL(1) of the first image signal, a vertical synchronization input 23 for the vertical synchronization signal VS(1) and a horizontal synchronization input 24 for the horizontal synchronization signal HS(1).

Via a third data bus 25 for a horizontal count HC, the display counting device 8 is connected to the second control device 6 as well to the serial read-out control device 9 on its output side. Furthermore, the display counting device 8 is connected to the serial read-out control device 9 via a fourth data bus 26 for a vertical count VC.

The output side of the second control device 6 is connected to inputs of the video storage device via a control bus 27 and an address bus 28. The control bus 27 comprises one line for each of the following signals: a row address transfer signal RAS, a column address transfer signal CAS, a write command signal WB/WE and a data transmission signal DT/OE for transferring a data line from the video storage device 4 to a read-out shift register thereof (not shown).

The output side of the serial read-out control device 9 is connected to control inputs of the video storage device 4 via a second control bus 29 for control signals SC, SOE for reading the video storage device 4. Video storage device 4 is, in turn, connected to a data input of the serial readout control device 9 via a fifth data bus 30, the read-control device 9 comprising a vertical synchronization input 31 for the vertical synchronization signal VS(2) of the second image signal on the monitor side, a clock input 32 for a second clock signal CLK(2) with the second pixel frequency, a blank input 33 for the second blank signal BL(2) as well as a horizontal synchronization input 34 for the horizontal synchronization signal HS(2) of the second image signal on the monitor side.

The output side of the serial read-out control device 9 is connected to the digital-to-analog converter DAC of the monitor (not shown) via a sixth data bus 35. In view of the fact that the structure of the monitor corresponds to the structure normally used in the prior art, an explanation thereof is not necessary.

In the following, the mode of operation of the preferred embodiment according to FIG. 1 will be explained; with regard to the details of the circuitry and with regard to the functional details, reference will, however, be made to the subsequent explanation concerning FIG. 2 to 10.

The register device 2 carries out a serial-parallel conversion of four respective successive data words applied to the input data bus 10 with the pixel frequency, the data words produced on the output side including four times the number of bits, i.e., they are data words with a length of 16 bits which are sent to the first data bus 13 in parallel. This conversion of 4-bit data words into 16-bit data words takes place under the control of the first control device 5 by means of the selection signals SEL0, . . . SEL3, the first control device 5 supplying a write command signal 15 to the fifo storage device 3 when this conversion has been completed. As soon as at least one data word has been stored in the fifo storage device 3, the flag EF supplied to the second control device 6 by fifo storage device 3 and indicating the empty storage condition of the device 3 will disappear, whereby the second storage device is informed of the fact that data words which can be re-stored in the video storage device 4 are present in the fifo storage device 3. As will be evident from the name, the fifo storage device 3 (first in-first out storage device 3) is constructed in such manner that, in response to selection by the read command RF, the data words which have first been read into fifo storage device 3 will first be read into the video storage device 4 via the second data bus 20. As explained below in detail, the second control device causes per write cycle of the video storage device 4 and per read cycle of the fifo storage device 3, respectively, re-storage of a plurality of data words from said first storage device 3 into the video storage device 4; the number of data words restored can vary from case to case, as explained below.

As explained in more detail below, the second control device 6 needs information on the number of pixels per line of the image signal applied to the input side for correctly storing the digital image signal in the video storage device, said information being also required by the serial read-out control device 9, which additionally needs the number of lines of the image of the input-side image signal for effecting read-out control. For this purpose, the display counting device 8 determines, in the case of the preferred embodiment shown, a horizontal count HC(0 . . . )) by counting the clock signals CLK(1) between two blank signals BL(1) as well as the number of lines of the image, which is represented by the first image signal, as a vertical count VC(0 . . . 9) by counting the number of blank signals BL(1) between two vertical synchronization signals vs(1).

The second control device operates on a time basis, which is determined by the oscillator 7, the start of a cycle being determined by the appearance of the vertical synchronization signal VS(1) at the reset input. The second (output-side) blank signal BL(2), which is also supplied to the second control device, is only used for controlling the refreshing the dynamic video storage device 4 and for controlling the shift register transfer, which permits transfer of a whole storage line from the video storage device 4 to the output shift register (not shown), and, for this purpose, it interrupts the cycle control for controlling the fifo storage device 3 and the video storage device 4. Control of the video storage device is started by addressing the first line and the first column of the video storage device 4 in the case of non-existence of the flag EF, the address transfer being controlled by the row address transfer signal RAS and the column address transfer signal CAS and the write command signal WB/WE being "low" during the writing mode. Transfer of the data words from the fifo storage device 3 to the video storage device 4 is effected in the so called "page-mode", in the case of which the line addressing and the line address transfer signal RAS remain unchanged when data words are being stored in the various columns of this line, whereby the write speed of the video storage device is increased in a manner known per se. The precise sequence of the individual control signals depends on the manufacturer's specification of the video storage device 4 for the "page-mode" writing fashion provided in the case of these devices. Details of the addressing will be explained precisely with reference to FIG. 9 and 10.

The control of serial reading of the video storage device by the serial read-out control device 9 is effected in synchronization with monitor-side second horizontal synchronization signal HS(2), vertical synchronization signal VS(2), clock signal CLK(2) and blank signal BL(2) in a manner known per se.

At this point, reference is made to an essential aspect of the present invention resulting from the conversion which is carried out in accordance with the invention and by means of which the image signal with the first pixel frequency is converted into an image signal with the second pixel frequency. It is possible to supply to the monitor not only the image signal generated at the output-side sixth data bus 35, but the image signal can also be combined with a second, synchronous image signal from which the output-side time base (VS(2), CLK(2), BL(2), HS(2)) was obtained. This permits a combination of an arbitrary first image signal, which is applied to the input 10, 11 of the circuit, with an arbitrary second image signal, which originates from a different graphic standard, in such a way that the first image signal is displayed on a patch of the monitor, whereas the second image signal is displayed on the rest of the monitor surface.

Figure 2:
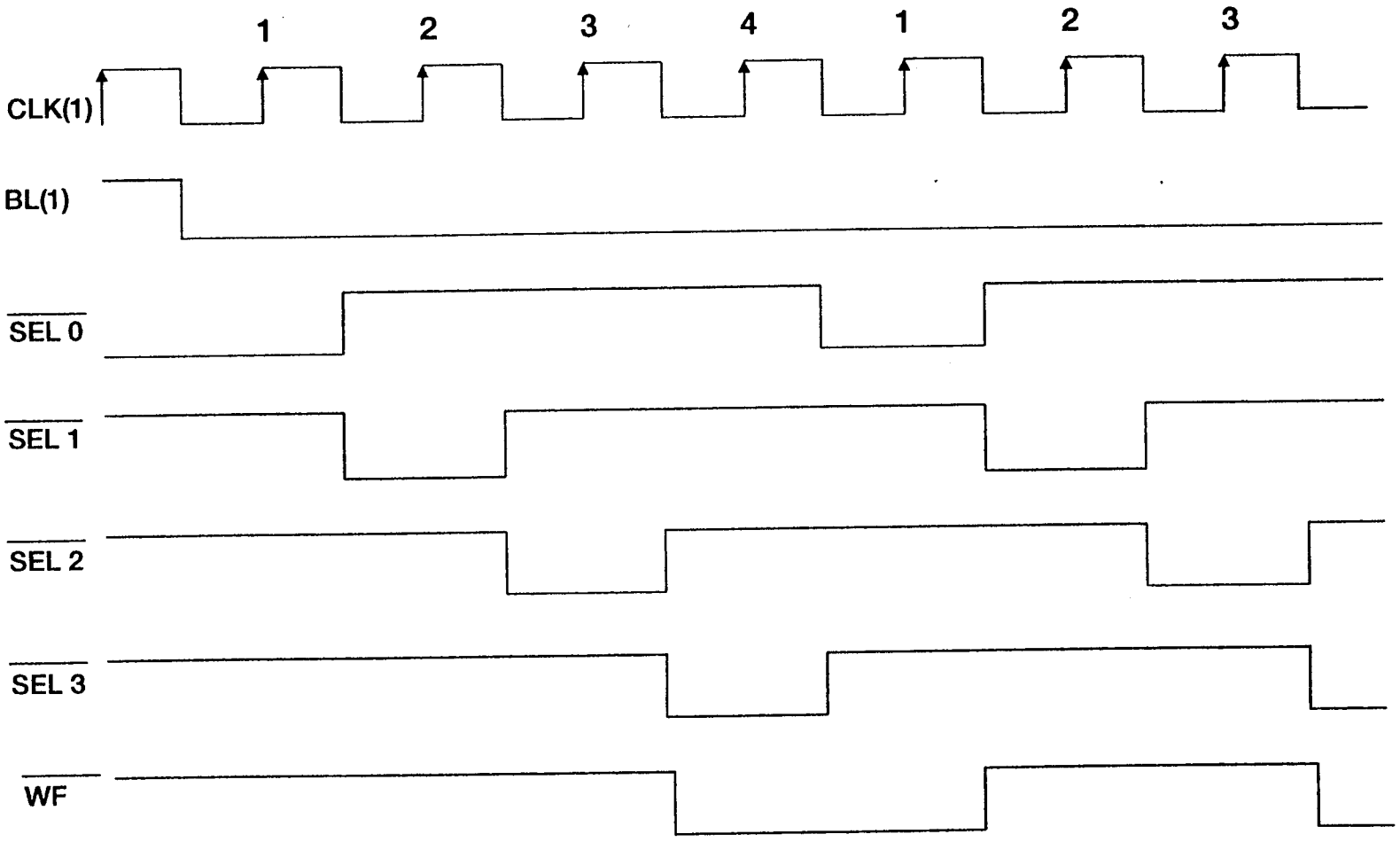
FIG. 2 shows a temporal representation of signal behavior for explaining the mode of operation of a first control device according to FIG. 1.

FIG. 2 and 3 elucidate the mode of operation of the first control device 5, which operates essentially as a counter. The first control device 5 is set to an initial condition by means of the first blank signal BL(1) so as to reset a zeroth selection signal SEL0 and set a first selection signal SEL1 (with circuit dependent delay) in response to the appearance of a first clock pulse CLK(1), the first selection signal being reset and the second selection signal SEL2 being set in response to the second clock pulse CLK(2), etc., and, subsequently, the third selection signal SEL3 is reset and the fifo write signal WF is set after the third pulse, whereupon the third selection signal is reset after the fourth clock pulse and the fifo write signal is reset after the subsequently following first clock. These staggered selection signals SEL0 to SEL3 are used for controlling the register device 2 whose detailed structural design will be explained precisely with reference to FIG. 4.

The register device 2 comprises three 4-bit registers 36, 37, 15 38 and one 16-bit register 39, which are all connected to the clock signal input 11 and the input data bus 10. The outputs of the 4-bit registers 36 to 38 are connected to the inputs of the 16-bit register 39. The registers 36 to 39 are selected, in a sequence corresponding to the sequence of their reference numerals, by means of the selection signals SEL0 to SEL3 so that, when the 16-bit register 39 is selected by the fourth selection signal SEL3, four input side 4-bit data words have been converted into an output side 16-bit data word.

Making reference to FIG. 5 to 8, the structure and the function of the display counting device 8 will be explained in detail hereinbelow. FIG. 5 shows the temporal relation between the first horizontal synchronization signal HS(1), the first blank signal BL(1) and the first clock signal CLK(1).

As can be seen from FIG. 6, the display counting device 8 comprises a horizontal counter 40 whose clock input has supplied thereto the first clock signal CLK(1) and whose reset input has supplied thereto the first horizontal synchronization signal HS(1). The first blank signal BL(1) controls the transfer of the count of the horizontal counter 40 to the register 41 for the horizontal count HC appearing at the output side on bus 25.

FIG. 7 shows (of course on a time basis which has been condensed in comparison with FIG. 1) the schematic temporal relationship between the first blank signal BL(1), the first horizontal synchronization signal HS(1) and the first vertical synchronization signal VS(1).

FIG. 8 shows the part of the display counting device 8 which concerns vertical counting or line counting and which includes a vertical counter 42 whose clock input has supplied thereto the first blank signal BL(1) and whose reset input has supplied thereto the first vertical synchronization signal VS(1), the output side of vertical counter 42 being connected to a register 43 for the vertical count VC whose clock input is, in turn, controlled by the first vertical synchronization signal, the output side of register 43 being connected to the fourth data bus 26 to which the vertical count VC is applied.

Figure 9:
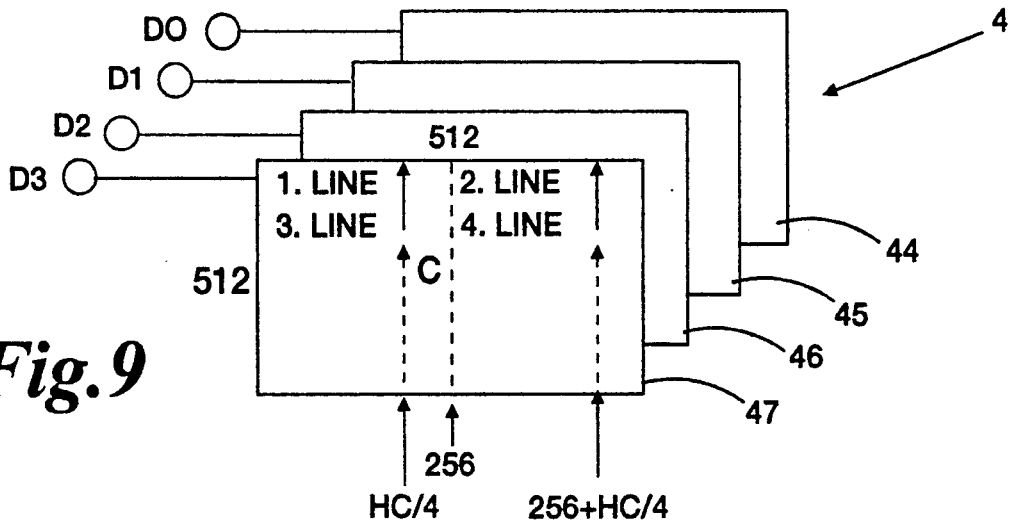
FIG. 9 shows a schematic representation of the memory organization of a video storage device shown in FIG. 1.

FIG. 9 shows the structure of the video storage device 4, which is subdivided into four storage levels 44 to 47 in the case of the example shown. This subdivision of the video storage device permits a reduction of the data flow rate while storing as well as simplified addressing.

In the case of the example shown, each of the storage levels 44 to 47 is provided with 512×512 storage locations, storage levels 44 to 47 being each divided at the horizontal address 256. A memory organization of 1,024×1,024 locations is obtained. When data words are being stored in the video storage device, the respective data are simultaneously supplied to the inputs D0 to D3, and, in the "page-mode" storing fashion described, the first line of the image will first be stored in the respective first storage lines between the horizontal addresses 0 and a maximum address corresponding to the horizontal count HC divided by the number 4 of storage levels. After having reached this horizontal address, the horizontal address counter (yet to be described) jumps to the horizontal address 256, at which the storage level is divided, and then counts from this horizontal address value up to a value increased by the horizontal count HC divided by the number of storage levels, and then, after storage of the second line of the first image signal, the third line of the first image signal will be stored in the second line of the video storage device 44 to 47; 4. Incrementing of the row address counter occurs after each second arrival at the horizontal count HC divided by the number of storage levels.

Figure 10:
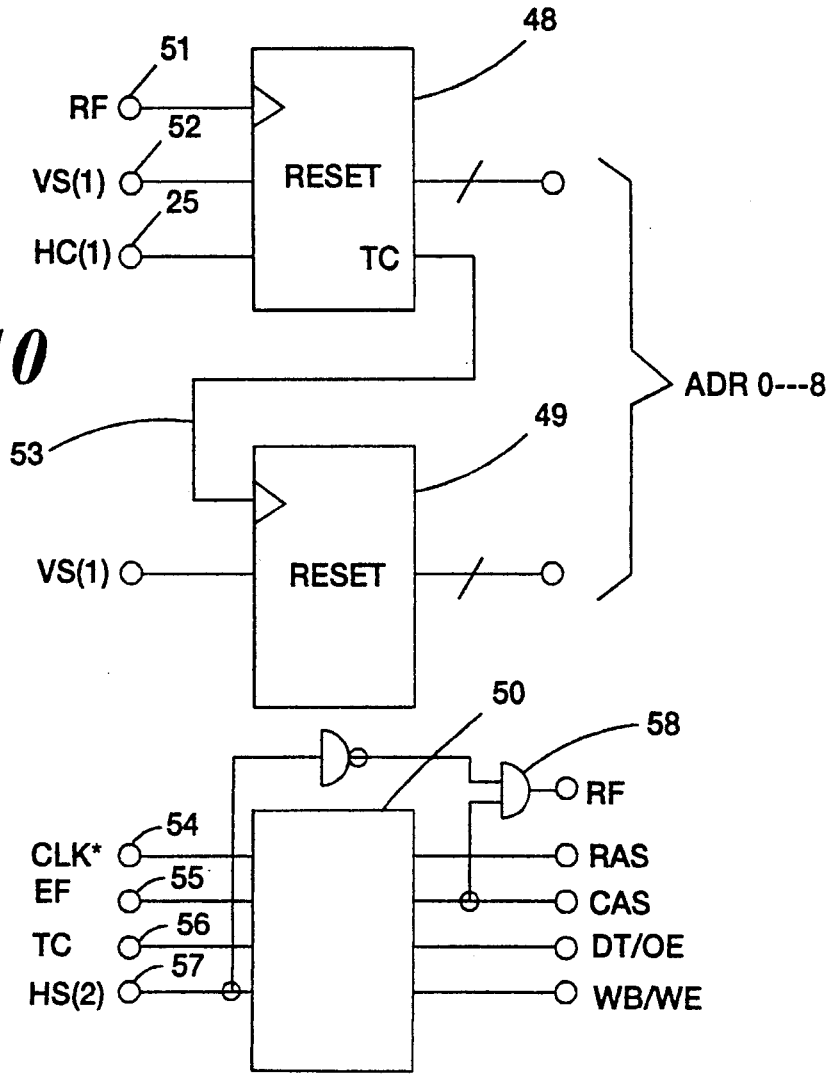
FIG. 10 shows block diagrams of the structure of a second control device shown in FIG. 1.

A block diagram of the second control device is shown in FIG. 10, and comprises a column address counter 48, a row address counter 49 and a control signal generator for generating the control signals for the video storage device 4. The column address counter 48 is clocked by the fifo read signal RF at its clock input 51 and is reset by the first vertical synchronization signal VS(1) at its reset input 52, and, in addition, it is connected to the third data bus 25 for receiving the horizontal count HC.

After resetting of the column address counter 48, said counter 48 carries out the horizontal address counting which has been explained with reference to FIG. 9. In the case of the example shown, this is a counting process increasing from zero up to a quarter of the horizontal count HC and followed by a jump to the middle horizontal address 256; subsequently, the address is again continuously incremented until this middle address is exceeded by a quarter of the horizontal count HC. At this moment, "1" will appear at the control output TC of the column address counter 48, which is connected to the clock input 53 of the row address counter 49, said counter 49 being incremented by this signal pulse until it is reset by the appearance of the first vertical synchronization signal VS(1). Counter 48 and 49 can be any standard 4-bit counter capable of being cascaded, for example 74ALS163 from Texas Instruments.

The control signal generator 50 has supplied thereto the clock signal CLK* by the oscillator 7 at its clock input 54, the flag EF by the fifo storage device 3 at its flag input 55, the control signal TC by the column address counter 48 at its control signal input 56 as well as the secondary horizontal synchronization signal HS(2) at its horizontal synchronization input 57. The generation of the row address transfer signal RAS, of the column address transfer signal CAS, of the data transfer signal DT/OE for the transfer of data from the video storage device to the output shift register of said video storage device, and of the write signal WB/WE for the video storage device is effected in accordance with the specification of the respective video storage device for operation of said storage device in the "page-mode" writing fashion. The read signal RF can be produced by ANDing of the column address transfer signal CAS and of the second horizontal synchronization signal HS(2) by means of a gate 58. An example of a suitable circuit that performs the above noted functions, such that it can be used without major modification, is the graphics processor TMS34010, available from Texas Instruments. If fast page mode is desired, a Texas Instruments graphics processor TMS34020 could be used.

In the case of the embodiment described, a register device is used for converting the input-side data words with the first pixel frequency into data words having a multiple bit length at a first pixel frequency divided by the corresponding multiple, and this permits a reduction of the requirements which have to be fulfilled by the speed at which data can be stored in the fifo storage device. The input side register device can, however, be dispensed with, if the first image signal has sufficiently low data word rate or if a fifo storage device with a sufficiently high operating speed is used. In this case, the first control device is not necessary either.

In the case of the embodiment explained, storage in the video storage device is carried out starting from a horizontal address 0 and a vertical address 0, i.e., starting from the left upper corner of the video storage device.

The subject matter of the invention is not limited to a specific number of bits in the data words of the image signal processed, and it is applicable to black-and-white image signals as well as to color image signals. If, for example, a color variety of 256 colors is desired, which would correspond to input data words of 8 bits, two circuits according to FIG. 1 can be connected in parallel.

Although the preferred embodiment of the subject matter of the invention is implemented in hardware by means of gate arrays, it is also conceivable to realize counting devices and control devices as well as a suitable control means for the first storage device, which makes said storage device operate as a fifo storage device, in software.

Fundamentally, the monitor control circuit according to the present invention is essentially used for driving a monitor whose pixel frequency differs from that of the digital image signal to be displayed on said monitor. However, the term "first pixel frequency" of the image signal and the term "second pixel frequency" of the monitor are to be interpreted in so broad a manner that they also cover signals having the same or similar frequencies with different phases and synchronization, respectively.

The present invention does not necessarily use a fifo storage device, but comprises as a first storage device all the memories from which data or data groups which have been stored first can be read out first; in the case of the data group alternative, the sequence in which the data are read out within the data groups is immaterial.

What is claimed is:

1. A monitor control circuit for driving a monitor, which operates at a second pixel frequency, on the basis of a digital image signal with a first pixel frequency, comprising:

a first storage device (3) into which the image signal can be read with a frequency dependent on the first pixel frequency by means of a first control device (5), and a video storage device (4) in effective connection with the output of the first storage device (3), characterized in that a first storage device is a fifo storage device (3), and that a second control device (6) is connected to the video storage device (4) and the fifo storage device (3) and is adapted to be used for reading data words of the digital image signal from the fifo storage device (3) and for writing them into the video storage device (4) in such a manner that the reading of the data words from the fifo storage device (3) is interrupted when data words are being read from the video storage device (4), whereby the number of data words stored in the fifo storage device (3) which can be re-stored in the video storage device (4) can vary.

2. A monitor control circuit according to claim 1, characterized by a register device (2), which has its input side connected to the fifo storage device (3) and by means of which the data words of the digital image signal received at the first pixel frequency can be converted into data words, which include a multiple number of bits with respect to the number of bits in the received data words, at a first pixel frequency divided by said multiple.

3. A monitor control circuit according to claim 2, characterized in that the register device (2) includes a number of first registers (36, 37, 38) equal to said multiple minus one, each of said registers (36, 37, 38) storing one of the received data words, that the register device (2) additionally includes a second register (39) for storing the data word which includes the multiple number of bits, said second register (39) having part of its inputs connected to outputs of said first registers (36, 37, 38) and another part of its inputs connected to a bus (10) for storing one of the received data words, and that the first control device (5) sequentially controls each of the first registers (36, 37, 38) and the second register (39) by a selection signal (SEL0, SEL1, SEL2, SEL3) for accepting input-side data words.

4. A monitor control circuit according to claim 3, characterized in that the first control device (5) is provided with a clock input (16), which is adapted to have supplied thereto a clock signal (CLK(1)) having the first pixel frequency, and with a holding input (17), which is adapted to have supplied thereto a blank signal (BL(1)) of the first image signal, and that the first control device (5) has a number of selection outputs (12) corresponding to said multiple and is constructed in such way that the respective signals (SEL0, SEL1, SEL2, SEL3) at the selection outputs (12) are displaced with respect to one another by a first pixel period.

5. A monitor control circuit according to claim 3, characterized in that the first control device (5) additionally includes a write command output for producing a write command (WF) for the fifo storage device (3), said write command (WF) being displaced by at least one first pixel period with respect to the selection signal (SEL3) for the second register (39), and that the fifo storage device (3) has a write command input (15) and accepts a waiting data word when a write command is applied.

6. A monitor control circuit according to claim 1, characterized by a display counting device (8), which is adapted to have supplied thereto a first clock signal (CLK(1)) having the first pixel frequency and a first blank signal (BL(1)) of the first image signal, said display counting device (8) being provided with a horizontal counter (40, 41) for counting the first clock signals (CLK(1)) between two first blank signals (BL(1)).

7. A monitor control circuit according to claim 6, characterized in that the display counting device (8) additionally included a vertical counter (42, 43), which is adapted to have supplied thereto the first blank signals (BL(1)) and the first vertical synchronization signals (VS(1)) and by means of which the number of first blank signals (BL(1)) between two first vertical synchronization signals (VS(1)) can be ascertained.

8. A monitor control circuit according to claim 1, characterized in that fifo storage device (3) has a reset input (14), which is adapted to have supplied thereto the first vertical synchronization signal (VS(1)).

9. A monitor control circuit according to claim 8, characterized in that said fifo storage device (3) has a flag output for a flag (EF) indicating the empty condition of the storage areas of the fifo storage device (3), and that the flag output is connected to a flag input of the second control device (6).

10. A monitor control circuit according to claim 7, characterized in that the second control device (6) has a read command output (RF) which is connected to a read control input of the fifo storage device, and that the fifo storage device (3) is constructed in such a way that in response to each read command pulse (RF) applied to its read control input it will transfer a data word to the video storage device (4).

11. A monitor control circuit according to claim 1, characterized in that the second control device (6) has a reset input, which is adapted to have supplied thereto the vertical synchronization signal (VS(1)) of the first image signal, and that the second control device (6) is additionally provided with a clock input which has connected thereto an oscillator (7).

12. A monitor control circuit according to claim 6, characterized in that the second control device (6) is connected to the display counting device (8) and receives therefrom at least the count (HC) of the horizontal counter (40, 41).

13. A monitor control circuit according to claim 10, characterized in that the second control device (6) is connected to the display counting device (8) and receives therefrom at least the count (HC) of the horizontal counter (40, 41), that, for driving the video storage device (4) on the time basis of the clock predetermined by the oscillator (7), the second control device (6) will start from a logical initial condition and produce, per read cycle, one read command pulse (RF) for the fifo storage device (3), one horizontal address signal (ADR) and one vertical address signal (ADR) for addressing the video storage device (4) and video storage control signals (RAS, CAS, WB/WE, DT/OE) in response to the appearance of the first vertical synchronization signal (VS(1)).

14. A monitor control circuit according to claim 13, characterized in that the video storage device (4) is provided with an output shift register, and that the video storage control signals comprise a column address transfer signal (CAS), a line address transfer signal (RAS), a write signal (WB/WE) representative of the write condition for writing into the video storage device (4) and a shift register transfer signal (DT/OE) permitting transfer of a data word from the video storage device (4) to the output shift register.

15. A monitor control circuit according to claim 14, characterized in that the second control device (6) produces the above-mentioned control signals for the video storage device (4) in a way, dependent on the specification of the video storage device (4) used, such that the data words supplied by the fifo storage device (3) are written into the video storage device (4) in the so-called "page-mode" memory control fashion, in the case of which the line address signal (ADR) and the line address transfer signal (RAS) for the video storage device (4) remain unchanged when data are being stored in a line of the video storage device (4).

16. A monitor control circuit according to claim 1, characterized in that the video storage device (4) is subdivided into a plurality of storage levels (44 to 47) adapted to be horizontally and vertically addressed at the same time and adapted to be written and read at the same time.

17. A monitor control circuit according to claim 1, characterized in that the video storage device (4) is subdivided at at least one horizontal address (256) into at least one first and one second storage area (0 to 255, 256 to 512), that the second control device (6) is constructed such that it will first count the horizontal address from zero to the count (HC) of the horizontal counter (40, 41) and, subsequently, after a jump, it will continue to count from the horizontal address (256), which determined the horizontal division of the video storage device (4, 44 to 47), up to the horizontal division address (256) increased by the count (HC) of the horizontal counter (40, 41), and that the horizontal address produced by the second control device (6) is reset by the first vertical synchronization signal (VS(1)).

18. A monitor control circuit according to claim 10, characterized in that the second control device (6) has a reset input, which is adapted to have supplied thereto the vertical synchronization signal (VS(1)) of the first image signal, that the second control device (6) is additionally provided with a clock input which has connected thereto an oscillator (7), and that, for driving the video storage device (4) on the time basis of the clock predetermined by the oscillator (7), the second control device (6) will start from a logical initial condition and produce, per read cycle, one read command pulse (RF) for the fifo storage device (3), one horizontal address signal (ADR) and one vertical address signal (ADR) for addressing the video storage device (4) and video storage control signals (RAS, CAS, WB/WE, DT/OE) in response to the appearance of the first vertical synchronization signal (VS(1)).

19. A method of driving a monitor, which operates at a second pixel frequency, the monitor being adapted to produce a display by reading an output-side digital image signal with the second pixel frequency from a video storage device (4), on the basis of all the data words of an input-side digital image signal having a first pixel frequency, comprising:

reading each of successive data words of the input-side digital image signal into a fifo storage device (3) with a frequency depending on the first pixel frequency;

reading data words of the digital image signal which are to be stored in the video storage device (4) from the fifo storage device (3) only during time periods during which no data words are being read from the video storage device (4), whereby the number of data words which can be read from the fifo storage device (3) for storage in the video storage device (4) will vary.

20. A monitor control circuit for driving a monitor, which operates at a second pixel frequency, said monitor being adapted to produce a display by reading an output-side digital image signal with the second pixel frequency from a video storage device (4), on the basis of all the data words of a digital image signal having a first pixel frequency, comprising:

a fifo storage device (3), a first control device (5) reading each of the successive data words of said input-side digital image signal into said fifo storage device (3) with a frequency depending on said first pixel frequency, a second storage device (6) for controlling the reading of data words of said digital image signal which are to be written into said video storage device (4) from said fifo storage device (3), said second storage device (6) effecting said reading of data words from the fifo storage device (3) only during time periods during which no data is being read from said video storage device (4), whereby the number of data words which can be read from said fifo storage device (3) for storage in said video storage device (4) will vary.

* * * * *